US005511617A

United States Patent [19]

Snider et al.

[11] Patent Number: 5,511,617

[45] Date of Patent: Apr. 30, 1996

[54] APPARATUS AND METHOD FOR TEMPORARILY PLUGGING A TUBULAR

[76] Inventors: Philip M. Snider, 12102 Rocky Lake Dr., Houston, Tex. 77070; David S. Wesson, Rte. 6, Box 337 A, Waxahachi, Tex. 75165; Lyle W. Andrich, 735 Newport Dr., Mansfield, Tex. 76063

[21] Appl. No.: 496,547

[22] Filed: Jun. 29, 1995

Related U.S. Application Data

[63] Continuation of Ser. No. 286,064, Aug. 4, 1994, abandoned.

[51] Int. Cl.[6] ..... F21B 33/13; F21B 33/134

[52] U.S. Cl. ..... 166/291; 166/185; 166/191; 166/317

[58] Field of Search ..... 166/150, 151, 166/291, 317, 363, 364, 386, 185, 191; 175/318

[56] References Cited

U.S. PATENT DOCUMENTS

| | | | |
|---|---|---|---|
| 3,882,935 | 5/1975 | Calhoun | 166/322 |
| 4,263,929 | 4/1981 | Kearney | 137/68 R |
| 4,427,070 | 1/1984 | O'Brien | 166/317 |
| 4,510,994 | 4/1985 | Pringle | 166/156 |
| 4,566,541 | 1/1986 | Moussy et al. | 166/317 X |
| 4,580,635 | 4/1986 | Radford et al. | 166/311 |
| 4,842,062 | 6/1989 | Schneider et al. | 166/317 X |
| 4,951,697 | 8/1990 | Fritts | 137/68.1 |
| 5,012,867 | 5/1991 | Kilgore | 166/317 X |
| 5,117,910 | 6/1992 | Brandell et al. | 166/291 |
| 5,180,015 | 1/1993 | Ringgenberg et al. | 166/386 |
| 5,279,370 | 1/1994 | Brandell et al. | 166/386 |
| 5,305,828 | 4/1994 | White et al. | 166/151 X |

*Primary Examiner*—Frank S. Tsay
*Attorney, Agent, or Firm*—Jack L. Hummel; Jack E. Ebel

[57] ABSTRACT

An apparatus and method for controlling the pressure at which a fluid is introduced into a well penetrating a subterranean formation. The apparatus comprises a blow out sub having a sealed chamber between two plugs. The chamber is filled with a fluid at a known pressure. Thus, the pressure required to release the first plug is independent of the pressure in the well below the sub. The sub is attached to a tubular and positioned within the well. The first plug is then released upon application of a predetermined pressure fluid pressure, and the second plug is released upon application of a lesser pressure. The blow out sub may additionally comprise a tube forming a channel through the first plug, the chamber, and the second plug, with a means for controlling fluid flow through the channel. A first fluid may be introduced into the well via the channel prior to releasing the first plug.

37 Claims, 5 Drawing Sheets

APPARATUS AND METHOD FOR TEMPORARILY PLUGGING A TUBULAR

CROSS REFERENCE TO RELATED APPLICATION

This application is a continuation of copending U.S. patent application Ser. No. 08/286,064, filed on Aug. 4, 1994, which is now abandoned.

BACKGROUND OF THE INVENTION

1. Field of the Invention

This invention relates generally to an apparatus and method for temporarily plugging a tubular in a well penetrating a subterranean formation, and in particular to an apparatus and method for controlling the pressure at which a fluid is introduced into the well and/or the formation whereby the plug opens upon application of a predetermined pressure.

2. Description of Related Art

When conducting an operation within a well penetrating a subterranean formation, it is often desirable to initiate the operation after particular conditions are met within the well. For example, it is desirable in hydraulic fracturing to introduce a fluid at a predetermined pressure simultaneously to a series of existing perforations in a well. Another example is the placement of packers in the desired position prior to establishing a seal between the packer and the well casing and tubing or other hardware in the well thus, a temporary plug may be installed within or at the end of a tubular and then opened when the desired conditions are met. Blow out subs attached to tubulars are commonly used to carry out such operations. A blow out sub is a device having a valve or plug which can be opened to provide fluid communication between a space within the tubular and the exterior of the tubular.

In many blow out subs, hydraulic pressure is utilized to rupture or shear a plug which prevents fluid flow. One type of plug is a rupture disk composed of a frangible material which shatters or fails when the pressure difference between the two sides of the disk exceeds a particular value. Large diameter, high strength rupture disks are generally expensive and difficult to manufacture. Therefore, rupture disks tend to be utilized in applications where the disk diameter and/or pressure differential are relatively small. Another type of plug comprises a shear pin connecting a stationary member, such as a wall or housing, and a moveable member, such as a piston. The shear pin fails when the pressure differential across the piston reaches a certain value, and the piston then moves so as to equalize the pressure on either side. Shear pins can be manufactured in a wide range of strengths, and the applied force can be distributed between 2 or more pins.

Blow out subs commonly include plugs designed to fail on the basis of the pressure difference between the fluid in the tubular above the plug and the fluid below the plug. In oil field operations, the pressure above the plug is generally well known, but the pressure below the plug is often poorly known or estimated. For example, bottom hole pressure measurements may not have been performed in a new well, or the time required for pressure buildup after a well is shut in may not be known. Thus, the well pressure may be unknown at the time an operation is conducted. If the estimated pressure below the plug is incorrect, the plug may open at the wrong time, or it may not shear at all, possibly causing severe adverse consequences for the attempted operation. For example, a particular fluid pressure is required for successful hydraulic fracturing of a subterranean formation. If the fluid pressure below the plug is underestimated, the plug may open when the pressure above the plug is too low to fracture the formation. Thus, a need exists for installing a plug which opens reliably when the fluid pressure in the tubular reaches a predetermined value, independent of the pressure outside the tubular. The plug may be mounted in a blow out sub.

Devices intended to shear or fail upon application of pressure in excess of a predetermined value are also used to detect overpressure situations in industrial process equipment. For example, a chamber between two frangible disks is filled with a fluid at a known pressure, such as atmospheric pressure. The disks rupture when the pressure in the industrial process equipment exceeds a predetermined absolute value. However, these pressure monitors serve different functions than blow out subs. The pressure monitors are intended for use in side branches of pressurized fluid systems, while blow out subs are utilized in the direct fluid flow path. In addition, the industrial process monitors operate in environments with significantly lower pressures than would be expected in petroleum wells, where blow out subs are utilized.

Thus, it is an object of the present invention to provide a means by which a plug in a blow out sub may be opened upon attainment of a precise, predetermined absolute pressure in the tubular above the plug.

It is yet another object of the present invention to provide a means by which a plug in a blow out sub may be opened to introduce a second fluid into a well upon attainment of a precise, predetermined absolute pressure in the tubular above the plug after introduction of a first fluid.

It is a further object of the present invention to provide a method for controlling the pressure at which a fluid is introduced into a well penetrating a subterranean formation.

SUMMARY OF THE INVENTION

To achieve the foregoing and other objects, and in accordance with the purposes of the present invention, as embodied and broadly described herein, one characterization of the present invention comprises a blow out sub having a body and a means for attaching the sub to a tubular and providing fluid communication between the tubular and the sub. The body has an exterior and encloses an interior space. At least partially within the interior space are a first plug and a second plug, forming a sealed chamber within the interior volume. The chamber is filled with a fluid at a known pressure. A first means for controlling the movement of the first plug relative to the body and a second means for controlling the movement of the second plug relative to the body are provided. The first means is selected to fail upon application of a predetermined pressure to the first plug, independent of the pressure outside the tubular and sub. The second means is selected to fail upon application of a pressure less than the predetermined pressure but greater than the pressure of the fluid in the chamber. The first plug and/or the second plug may each comprise a rupture disk, and the first and/or second control means may each comprise a rupture disk. Alternatively, the first and/or second plug may each comprise a piston. The control means may be a lock or at least one shear pin connecting the piston to the body of the sub.

The blow out sub of the present invention may additionally comprise a tube forming a channel through the second plug, the chamber, and at least partially through the first plug, with a valve for controlling fluid flow through the channel.

Yet another characterization of the present invention comprises a method for controlling the pressure at which a fluid is introduced through a tubular. First and second temporary plugs are secured to a tubular at spaced apart locations, defining a fluid tight chamber within the tubular and between the plugs. The chamber is filled with a first fluid at a known pressure. The first plug is capable of opening upon application of a predetermined pressure which is greater than the known pressure of the first fluid in the chamber, and the second plug is capable of opening upon application of a pressure less than the predetermined pressure and greater than the known pressure. A second fluid is introduced into the tubular, and the predetermined pressure is applied to the second fluid. The pressure causes the first plug to open and subsequently causes the second plug to open, so as to permit the second fluid to flow past the locations of the plugs. The method may be used to control the pressure at which the second fluid is introduced into a subterranean well through a tubular. The first and second plugs may be secured to the tubular prior to inserting the tubular in the well, and the tubular is then used to position the plugs in the well. Alternatively, the tubular may be installed in the well prior to securing the plugs to the tubular, and a cable may be used to position the plugs in the tubular. The plugs may be mounted in a blow out sub which is secured to the tubular.

A channel may be present at least partly within the first plug to provided for fluid communication between the interior of the tubular above the first plug and the well outside the tubular. Thus, second and third fluids can be introduced into the well after the plugs are secured to the tubular and positioned in the well, but before the first plug is opened. The second fluid is introduced at a pressure less than the predetermined pressure and allowed to flow through said channel and into said well outside said tubular. The third fluid is then introduced into the tubular. The predetermined pressure applied to the second fluid may be built up sufficiently rapidly that the pressure exerted on the first plug increases faster than the third fluid can flow through the channel and into the well. Alternatively, a valve can be utilized to stop the flow of the third fluid through the channel. The pressure of the third fluid causes the first plug to open and subsequently causes the second plug to open, so as to permit the third fluid to flow past the spaced apart locations in the well.

BRIEF DESCRIPTION OF THE DRAWINGS

These and other features, aspects, and advantages of the present invention will become better understood with reference to the following description, appended claims, and accompanying drawings where:

DESCRIPTION OF THE PREFERRED EMBODIMENTS

The present invention comprises a method for controlling the pressure at which a fluid is introduced through a tubular, for example, into a subterranean well. A pressure at which the fluid is to be introduced is determined. Upper and lower temporary plugs are secured to the tubular, forming a fluid tight chamber between the plugs. The chamber is filled with a fluid, such as a liquid, air, or another gas, at a pressure less than the predetermined pressure. The upper plug is designed to open upon application of a pressure greater than the predetermined pressure, and the lower plug is designed to open upon application of a pressure less than the predetermined pressure and greater than the pressure of the fluid filling the chamber. The plugs may be secured to the lower end of a tubular, such as a tubing or casing string, or at positions along or within the tubular. The tubular and plugs may be assembled at the surface and positioned together in the well, or the plugs may be positioned within or at the lower end of the tubular, for example with a cable, such as a wireline or a slickline. As is apparent to one skilled in the art, any other suitable means may be used to position the plugs in the tubular. For example, the plugs may be within a blow out sub connected to a locking mandrel, and the mandrel is then attached to a nipple installed in a tubing string. Alternatively, a blow out sub may be positioned by means of a collar stop.

The present invention also comprises a blow out sub for introducing pressurized fluid into a well penetrating a subterranean formation. It is critical in hydraulic fracturing operations that fluid be supplied simultaneously, at a predetermined absolute pressure, to a series of perforations. Other operations such as setting packers and manipulating tools in a well, may also be improved by more precise control of the pressure under which the operations are conducted. In particular, these operations are affected adversely when an unexpected differential pressure causes a plug to shear at the wrong time. The present invention provides a solution to the problem of unpredictable actuation of blow out plugs by providing a chamber filled with fluid at a known pressure, such as atmospheric pressure. The plug is opened when the pressure in the tubular above the plug reaches the desired value, independent of the pressure in the well outside the tubular and sub. In the following discussion, the term "tubular" refers to a well casing, tubing, or coil tubing. Also, in the following discussion, like parts in each figure are labeled with the same numbers.

Figure 1:
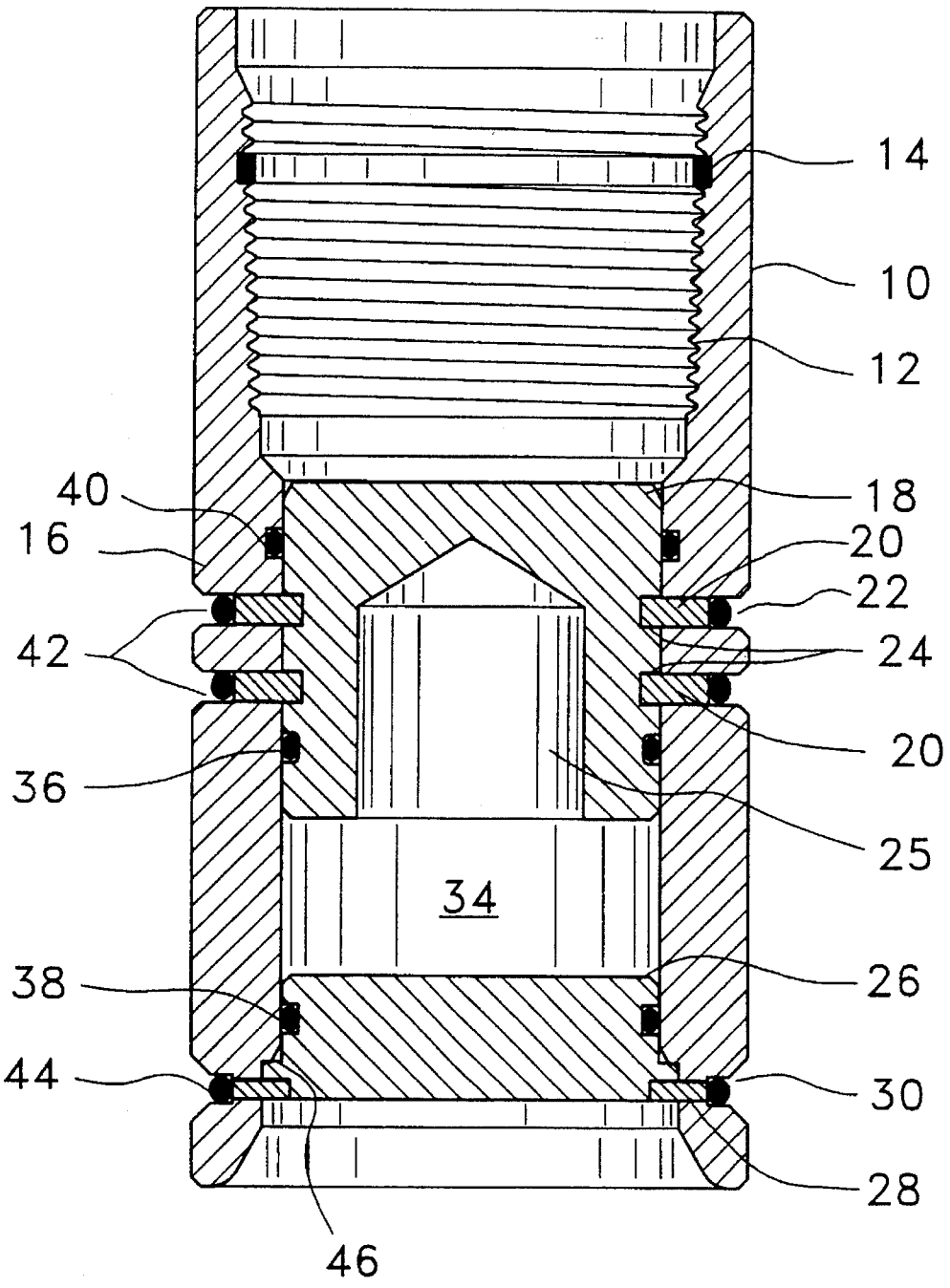
FIG. 1 is a cross section showing one embodiment of a blow out sub of the present invention.

Referring to FIG. 1, the body 10 of the tubular blow out sub of the present invention is provided with a means, such as screw threads 12, for attaching the sub to the end of a tubular, not shown. A seal ring 14 may be used to prevent fluid leakage through the screw threads after attachment. Below the screw threads 12, the interior wall of body 10 is beveled to form a thicker-walled section 16 into which a piston 18 is inserted. First shear pins 20 are inserted into holes 22 passing through body 10 and extend into recesses 24 in piston 18. Recess 25 in piston 18 reduces the weight of piston 18, thereby reducing wear on shear pins 20 as the tubular is lowered into the well. A bottom cap 26 is held in place by second shear pins 28 extending through holes 30 in body 10 into recesses 32 in bottom cap 26. At least one first shear pin 20 and at least one second shear pin 28 are used in the apparatus of the present invention. The exact number of each type of pin utilized depends upon the shear strength of each pin and the force to be applied to piston 18 and bottom cap 26, respectively. A chamber 34 is defined between the interior wall of body 10, the bottom of piston 18, recess 25 in piston 18, and the top of bottom cap 26. O rings 36 and 38, seal chamber 34, and O ring 40 prevents fluid in the tubing from leaking past first shear pins 20. Elastomeric rings 42 and 44 hold shear pins 20 and 28 in place. Shoulder 46 on bottom cap 26 prevents the cap from traveling upward relative to body 10.

In use, piston 18; bottom cap 26; O rings 36, 38, and 40; elastomeric rings 42 and 44; seal ring 14; and shear pins 20 and 28 are assembled as shown. Chamber 34 is filled with a fluid at a known pressure, such as air at atmospheric pressure. Depending on the needs of the particular application, another fluid could be supplied to chamber 34 at a greater or lesser pressure. As is apparent to one skilled in the art, one or more appropriate valves could be provided in body 10 or bottom cap 26 to facilitate filling chamber 34. First shear pins 20 are selected to yield when the absolute fluid pressure in the tubular reaches a predetermined value. Second shear pins 28 are selected to yield upon application of a lower pressure than is required for shear pins 20 to yield. The assembly is then attached to a tubular, not shown, and positioned in a well. When it is desired to introduce fluid into the well and/or formation outside the tubular, the tubular is filled with fluid and pressure is applied until the force exerted on the top of piston 18 exceeds the strength of first shear pins 20 and the pressure in chamber 34. Piston 18 then travels downward through body 10 until sufficient pressure is exerted on bottom cap 26 to cause second shear pins 28 to yield. Second shear pins 28 yield at a lower force than first pins 20. Thus, if enough force is applied to cause piston 18 to move, bottom cap 26 will also be caused to move. Hydraulic pressure applied by the fluid in the tubular pushes both piston 18 and bottom cap 26 out of the end of body 10, establishing fluid communication between the interior of the tubular and the well outside the tubular. Piston 18 and bottom cap 26 then fall to the bottom of the well.

Because the pressure in chamber 34 is known, the first shear pins 20 holding piston 18 in place can be selected to yield when a predetermined pressure is reached in the tubular above piston 18. Thus, the problem encountered with prior art blow out sub assemblies, i.e., that the pressure at which the plug will release is uncertain, is eliminated.

Figure 2:
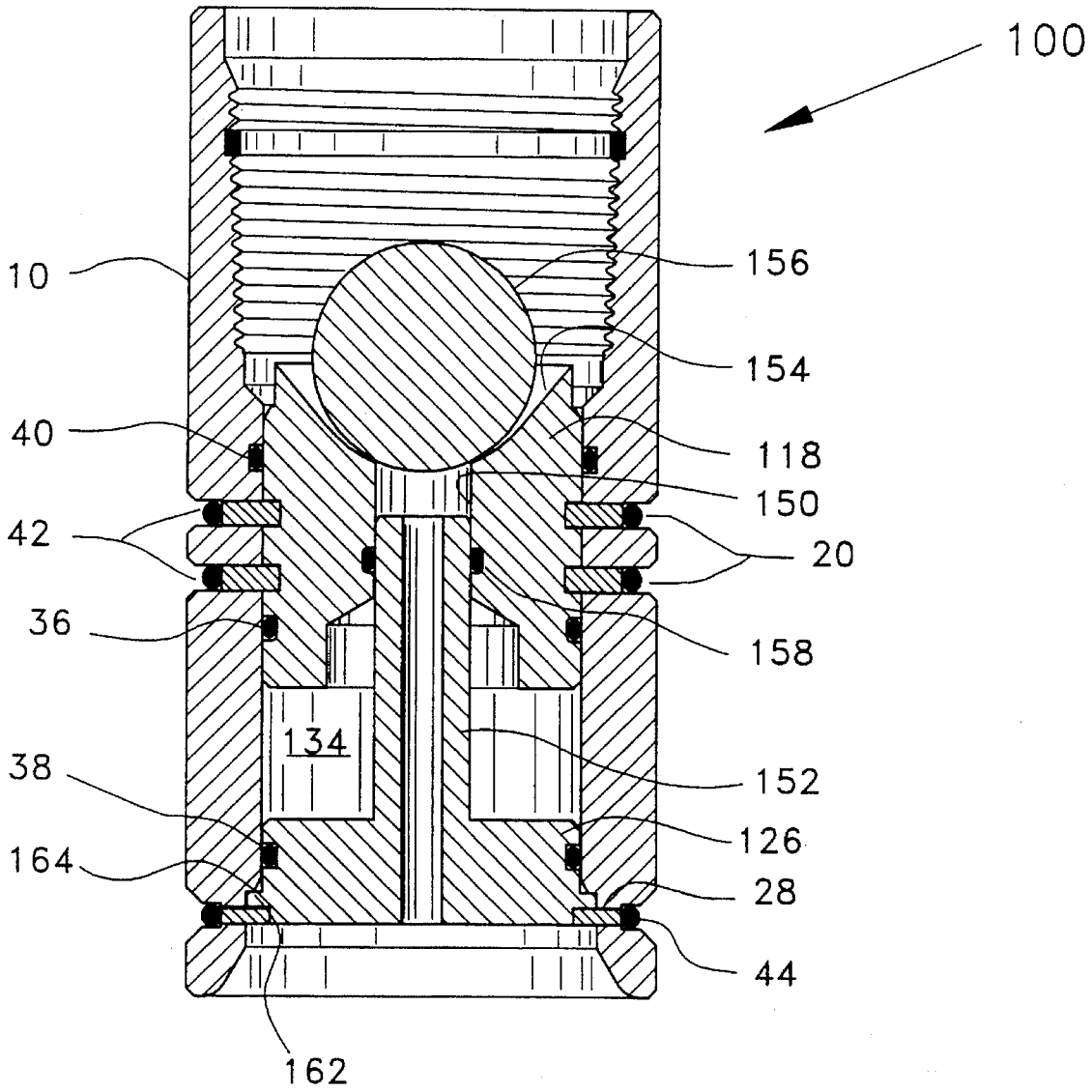
FIG. 2 is a cross section showing another embodiment of a blow out sub of the present invention.

If it is desired to introduce a first fluid into the well prior to injecting a second fluid at high pressure, the embodiment shown generally as 100 in FIG. 2 may be utilized. For example, the first fluid may comprise an acid or a sand slurry. Passage 150 is bored into piston 118. A hollow tube 152 forms a part of bottom cap 126. Alternatively, tube 152 could be attached to bottom cap 126, such as by means of screw threads. Tube 152 extends at least partially through passage 150, and the upper surface of piston 118 is flared to form a cup 156 in which ball 156 rests. Alternatively, the top of tube 152 could extend upward through passage 150 and terminate in a flared cup. Ball 156 and cup 154 comprise a valve to control the flow fluid through tube 152. As is apparent to one skilled in the art, any suitable valve, such as a sliding sleeve valve, could be utilized in place of a ball valve. O ring 158 provides a seal between tube 152 and piston 118. Chamber 134 is formed by the interior wall of body 10, the bottom of piston 118, the top of bottom cap 126, and the exterior wall of tube 152. Chamber 134 is filled with a fluid at a known pressure, such as air at atmospheric pressure.

Initially, the blow out sub is assembled without ball 156, attached to the tubular, and lowered into the well. Alternatively, if the tubular is already in the well, a wireline could be used to position the sub and attach it to a lock mandrel 152 in the tubular. A slug of the first fluid is injected into the tubular and passes through tube 152 into the well. Ball 156 is then dropped into the tubular from the surface, and the ball lands in cup 154, closing the entrance to tube 152. The tubular is then filled with the second fluid, and the pressure is increased until first shear pins 20 yield. Piston 118 then moves through the interior of body 10 and forces bottom cap 126 out of the end of body 10, as for the embodiment shown in FIG. 1.

Sub 100 could be operated without ball 156 if the pressure of the second fluid is increased rapidly enough that tube 152 functions as an orifice. Pressure builds up in the tubular above piston 118. Some fluid may pass through tube 152 and exert a back pressure on the bottom of bottom cap 126. However, shoulders 162 and 164 on bottom cap 126 and body 10, respectively, prevent bottom cap 126 from moving upward relative to body 10, thereby maintaining a constant pressure in chamber 134 until first shear pins 20 yield. Thus, the operation of the sub 100 is not affected by the back pressure exerted on bottom cap 126.

Figure 3:
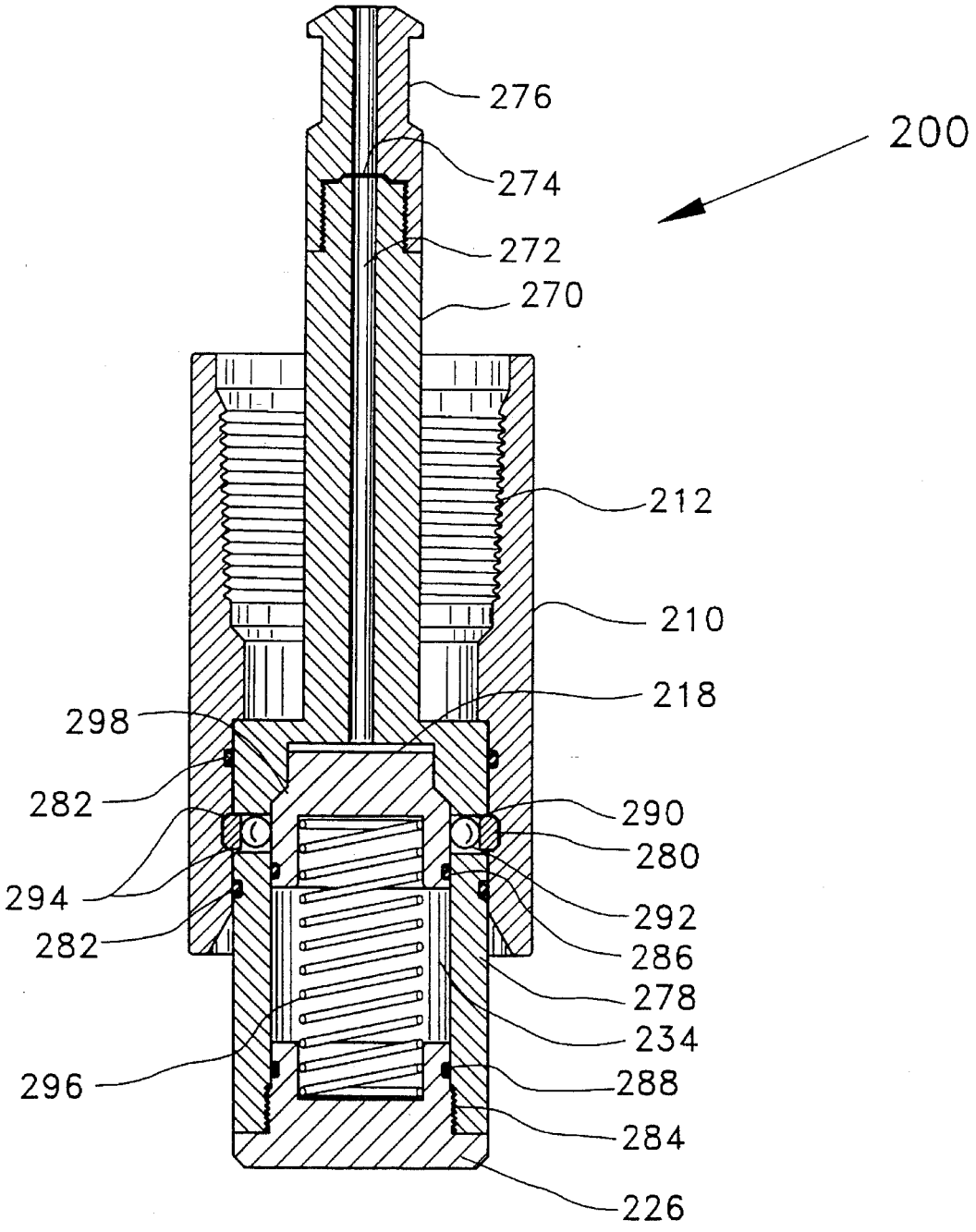
FIG. 3 is a cross section showing yet another embodiment of a blow out sub of the, present invention.

FIG. 3 illustrates another embodiment of the present invention, indicated generally as 200. A body 210 is provided with a means, such as screw threads 212, for attachment to the end of a tubular. Tube 270 provides a channel for fluid communication between the tubular above the sub 200 and the well below. A rupture disk 274 is secured between tube 270 and fishing neck 276. Chamber 272, between rupture disk 274, the top of piston 218, and the interior of tube 270, is filled with a fluid at a known pressure, such as air at atmosphere pressure. Another fluid could be used at a different pressure. The lower portion of tube 270 is widened to form a wall 278 enclosing piston 218 and chamber 234. Lock mechanism 280 holds tube 270 in position within body 210. O rings 282 provide seals between tube 270 and body 210. Bottom cap 226 is secured to the lower end of wall 278, shown with screw threads 284. O rings 286 and 288 provide seals between piston 218 and wall 278 and between bottom cap 226 and wall 278, respectively. Lock 280, located in recesses 290 in the interior surface of body 210, presses spheres 292 against the sides of piston 218. Lock 280, illustrated as a split ring, can be any mechanism that applies pressure to spheres 292 in a radial direction and is capable of moving radially in recess 290. As shown, a beveled shoulder 294 on lock 280 facilitates such motion. Optionally, a spring 296 is included within chamber 234. Chamber 234 is filled with a fluid at a pressure less than the fluid pressure required to rupture disk 274.

In operation, hydraulic pressure is applied to the top of disk 274, causing the disk to rupture. The fluid then contacts the top of piston 218, exerting a force sufficient to cause the piston to travel through chamber 234. When shoulder 298 on piston 218 passes below lock 280, the spheres 292 are pushed out of recesses 290, thereby releasing lock mechanism 280 and allowing tube 270 and wall 228 to move relative to body 210. As the piston 218 applies pressure to bottom cap 226, fishing neck 276 and tube 270 are forced out of the end of body 210 and allowed to fall to the bottom of the well, thereby opening a permanent fluid passage from the interior of the tubular, through body 210, to the exterior of the tubular. Spring 294 functions to maintain piston 218 in place as the blow out sub is positioned in the well. Fishing neck 276 may be used to recover tube 270 and its contents after the tubular is removed from the well.

Figure 4:
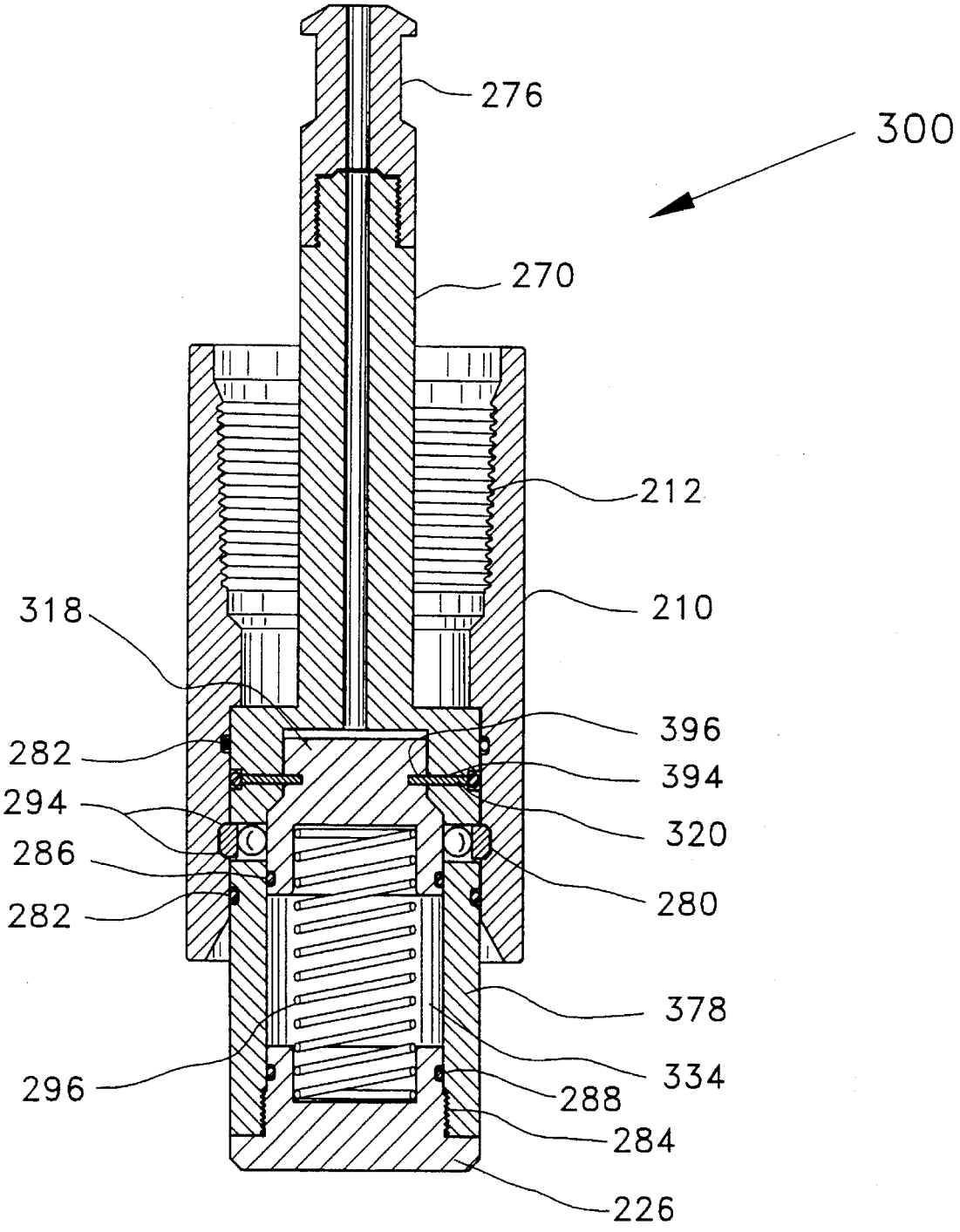
FIG. 4 is a cross section showing a further embodiment of a blow out sub of the present invention.

The embodiment shown generally in FIG. 4 as 300 is similar to that of FIG. 3, except that one or more shear pins 320 passing through holes 394 in wall 378 into recesses 396 in piston 318 replace rupture disk 274 shown in FIG. 3, and chamber 272 is not present. When sufficient pressure is applied to the top of piston 318, pins 320 shear. Lock 280 is then released.

Figure 5:
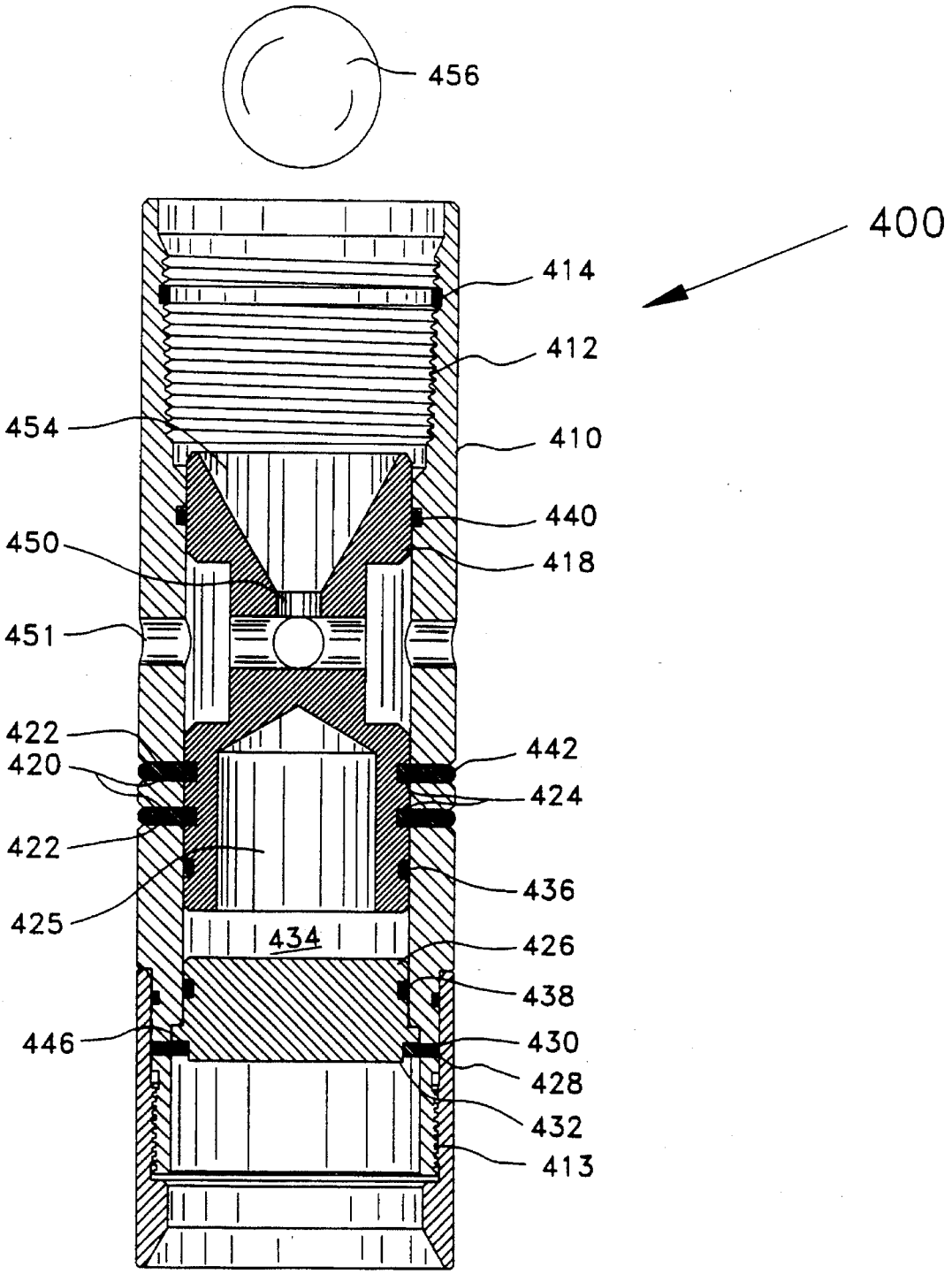
FIG. 5 is a cross section showing a still further embodiment of a blow out sub of the present invention.

An additional embodiment is shown in FIG. 5. A tubular blow out sub 400 has a body 410 capable of attachment to the end of a tubular, such as with screw threads 412. Seal ring 414 prevents leakage through the screw threads 412 after attachment. A piston 418 is inserted into the interior of the body. A bottom cap 426 is held in place by second shear pins 428 extending through holes 430 in body 410 into recesses 432 in bottom cap 426. The interior wall of body 410, the bottom and recess 425 of piston 418, and the top of bottom cap 426 define chamber 434. A cup 454 is carved into the upper surface of piston 418 and terminates at channel 450 within the upper portion of piston 418. Cup 454 and ball 456 comprise a ball valve. Alternatively, another valve mechanism may be used. For example, the cup may be conical, and a rod with a conical tapered end may be used in place of ball 456. Channel 450 provides fluid communication between the tubular and one or more ports 451 in body 410. O rings 440, 436, and 438 provide seals and prevent fluid leakage between the well outside the sub, chamber 434, and channel 450. First shear pins 420 are inserted into holes 422 passing through body 410 and extend into recesses 424 in piston 418. At least one first shear pin 420 and at least one second shear pin 428 are used in the apparatus of the present invention. Shear pins 420 are held in place by elastomeric rings 442. Shoulder 446 on bottom cap 426 prevents the cap from traveling upward relative to body 410.

In use, piston 418; bottom cap 426; O rings 436, 438, and 440; elastomeric ring 442; seal ring 414; and shear pins 420 and 428 are assembled as illustrated in FIG. 5. Chamber 434 is filled with a fluid at a known pressure. First shear pins 420 are selected to yield upon application of a predetermined pressure to piston 418 greater than the pressure of the fluid in chamber 434, and second shear pins 428 are selected to yield at a force between the fluid pressure in chamber 434 and the predetermined pressure. Optionally, a basket for retrieving the end cap (not illustrated) may be attached to the bottom of the sub, such as with screw threads 413 so that the component parts of the apparatus can be removed to the surface for reconstruction. The sub is attached to a tubular and positioned in the well. A first fluid is pumped or allowed to flow down the tubular and through channel 450 into the well. Fluid flow through the channel 450 can be terminated by dropping ball 456 from the surface through the tubular. Ball 456 seats in cup 454 in piston 418, blocking fluid from entering the top of channel 450. As is apparent to those skilled in the art, another type of valve could be utilized to control fluid flow through channel 450. A second fluid is then pumped into the well until the pressure applied to the top of ball 456 and piston 418 exceeds the predetermined value, causing shear pins 420 and 428 to fail in sequence. The second fluid may be the same as or different from the first fluid.

While the foregoing preferred embodiments of the inventions have been described and shown, it is understood that the alternatives and modifications, such as those suggested and others, may be made thereto and fall within the scope of the invention. For example, any suitable means, not limited to shear pins and rupture disks, may be utilized to control the opening of the plug.

We claim:

1. A blow out sub, comprising:

a body having an exterior and enclosing an interior space;

means for attaching the sub to a tubular and providing fluid communication between the tubular and the sub;

first and second plugs sealed to said body and defining a sealed chamber therebetween which is within the interior space, the chamber filled with a fluid at a known pressure;

a first means for controlling the movement of the first plug relative to the body, the first means selected to fail upon application of a predetermined force to the plug; and a second means for controlling the movement of the second plug relative to the body, said second means selected to fail upon application of a force which is less than the predetermined force but greater than the pressure of the fluid in the chamber.

2. The blow out sub of claim 1 wherein said first plug and said first means for controlling movement comprise a frangible disk.

3. The blow out sub of claim 1 wherein said first plug comprises a piston.

4. The blow out sub of claim 1 wherein said first means for controlling movement comprises at least one shear pin connecting said first plug to said body of said sub.

5. The blow out sub of claim 1 wherein said first means for controlling movement comprises a lock connecting said plug to said body of said sub.

6. The blow out sub of claim 1 wherein said second plug and said second means for controlling movement comprise a frangible disk.

7. The blow out sub of claim 1 wherein said second plug comprises a piston.

8. The blow out sub of claim 1 wherein said second means for controlling movement comprises at least one shear pin connecting said second plug to said body of said sub.

9. The blow out sub of claim 1 wherein said second means for controlling movement comprises a lock connecting said plug to said body of said sub.

10. The blow out sub of claim 1 wherein said blow out sub additionally comprises a tube forming a channel through said second plug, said chamber, and at least partially through said first plug.

11. The blow out sub of claim 10 wherein said blow out sub additionally comprises a valve for controlling fluid flow through the channel.

12. The blow out sub of claim 11 wherein said valve is selected from the group consisting of ball valves and sliding sleeve valves.

13. The blow out sub of claim 1 wherein said chamber additionally contains a spring.

14. The blow out sub of claim 1 wherein said fluid in said chamber is air.

15. The blowout sub of claim 1 wherein said fluid pressure in said chamber is atmospheric pressure.

16. The blow out sub of claim 1 wherein said fluid pressure in said chamber is less than atmospheric pressure.

17. The blow out sub of claim 1 wherein said fluid pressure in said chamber is greater than atmospheric pressure.

18. The blow out sub of claim 1 wherein said first plug encloses a channel providing fluid communication between said tubular and said well outside said sub.

19. The blow out sub of claim 18, additionally comprising a valve for controlling fluid flow through said channel.

20. The blow out sub of claim 19 wherein said valve is selected from the group consisting of ball valves and tapered sleeve valves.

21. A method for controlling the pressure at which a fluid is introduced through a tubular, the method comprising:

(a) securing first and second temporary plugs to a tubular, said plugs being spaced apart so as to define a fluid tight chamber therebetween which is filled with a first fluid at a known pressure, said first plug capable of opening upon application of a predetermined pressure and said second plug capable of opening upon application of a pressure which is less than said predetermined pressure and greater than said known pressure;

(b) introducing a second fluid into said tubular; and (c) applying a predetermined pressure to said second fluid thereby opening said first plug and subsequently opening said second plug, so as to permit said second fluid to flow past said spaced apart locations.

22. A method for controlling the pressure at which a fluid is introduced into a subterranean well through a tubular, the method comprising:

(a) securing first and second temporary plugs to a tubular, said plugs being spaced apart so as to define a fluid tight chamber therebetween which is filled with a first fluid at a known pressure, said first plug capable of opening upon application of a predetermined pressure and said second plug capable of opening upon application of a pressure which is less than said predetermined pressure and greater than said known pressure;

(b) introducing a second fluid into said tubular; and (c) applying a predetermined pressure to said second fluid thereby opening said first plug and subsequently opening said second plug, so as to permit said second fluid to flow past said spaced apart locations within a subterranean well.

23. The method of claim 22 wherein said plugs are secured to said tubular prior to putting said tubular in said well and said tubular is used to position said plugs in said well.

24. The method of claim 22 wherein said tubular is installed in said well prior to securing said plugs in said tubular and a cable is used to position said plugs in said tubular.

25. The method of claim 22 wherein said plugs are part of a blow out sub secured to said tubular.

26. A method for introducing a second fluid into a subterranean wellbore and for introducing a third fluid into the subterranean wellbore at a controlled pressure, the method comprising:

(a) securing first and second temporary plugs to a tubular, said plugs being spaced apart so as to define a fluid tight chamber therebetween which is filled with a first fluid at a known pressure, said first plug capable of opening upon application of a predetermined pressure said second plug capable of opening upon application of a pressure which is less than said predetermined pressure and greater than said known pressure, and the first plug having a channel at least partly therein providing for fluid communication between an interior portion of said tubular above said first plug and said well outside said tubular;

(b) introducing a second fluid into said tubular at a pressure less than the predetermined pressure and allowing the second fluid to flow through said channel and into said well outside said tubular;

(c) introducing a third fluid into said tubular; and (d) applying a predetermined pressure to said third fluid thereby opening said first plug and subsequently opening said second plug, so as to permit said second fluid to flow past said spaced apart locations within a subterranean well.

27. The method of claim 26 wherein said plugs are secured to said tubular prior to putting said tubular in said well and said tubular is used to position said plugs in said well.

28. The method of claim 26 wherein said tubular is installed in said well prior to securing said plugs in said tubular and a cable is used to position said plugs in said tubular.

29. The method of claim 26 wherein said tubular is installed in said well prior to securing said plugs in said tubular and a second tubular is used to position said plugs in said tubular.

30. The method of claim 26 wherein said second fluid is the same as said third fluid.

31. The method of claim 26 wherein said second fluid is different from said third fluid.

32. The method of claim 26 wherein said predetermined pressure is applied to said third fluid sufficiently rapidly that the pressure exerted on said first plug builds up faster than said third fluid can flow through said channel and into said well outside said tubular.

33. The method of claim 26 wherein a valve is provided for terminating the flow of said second fluid through said channel.

34. The method of claim 33 wherein said valve is selected from the group consisting of ball valves and sliding sleeve valves.

35. The method of claim 33, wherein said valve is opened before said first plug is positioned in said well.

36. The method of claim 26 wherein said tubular has at least one port passing therethrough adjacent said first plug and said channel provides for fluid communication through said at least one port.

37. The method of claim 26 wherein said channel provides for fluid communication with said well outside said tubular via a tube passing through said chamber and said second plug.

* * * * *